US005590548A

United States Patent [19]

Osborne

[11] Patent Number: 5,590,548

[45] Date of Patent: Jan. 7, 1997

[54] CIRCULARLY KNIT LEGGED PANTY HAVING KNIT-IN SHAPING PANELS, AND A BLANK AND METHOD FOR MAKING SAME

[75] Inventor: Harold G. Osborne, Boomer, N.C.

[73] Assignee: Alba-Waldensian, Inc., Valdese, N.C.

[21] Appl. No.: 482,553

[22] Filed: Jun. 7, 1995

Related U.S. Application Data

[63] Continuation-in-part of Ser. No. 382,864, Feb. 3, 1995.

[51] Int. Cl.[6] ..... A41B 9/02; A41B 9/04; A41B 9/06; A41C 1/00

[52] U.S. Cl. ..... 66/177; 66/171; 450/99; 2/401; 2/406

[58] Field of Search ..... 66/171, 176, 177, 66/153; 450/99; 2/401–406

[56] References Cited

U.S. PATENT DOCUMENTS

| | | | |
|---|---|---|---|
| 1,775,033 | 9/1930 | Wilkinson | 66/153 X |
| 2,174,948 | 10/1939 | Raven et al. | 66/153 |
| 2,668,953 | 2/1954 | Tofanelli | 2/28 |
| 2,928,397 | 3/1960 | Pucci | 128/523 |
| 2,980,114 | 4/1961 | Montoya | 128/523 |
| 3,131,698 | 5/1964 | Morano | 128/529 |
| 3,375,829 | 4/1968 | Brennan et al. | 128/539 |
| 3,413,824 | 12/1968 | Kuney | 66/177 |
| 3,425,246 | 2/1969 | Knohl | 66/176 X |
| 3,526,229 | 9/1970 | Blair | 128/539 |
| 4,325,379 | 4/1982 | Ozbey | 128/540 |
| 4,390,999 | 7/1983 | Lawson et al. | 2/409 |
| 4,531,525 | 7/1985 | Richards | 128/489 |
| 4,624,115 | 11/1986 | Safrit et al. | 66/172 R |
| 4,682,479 | 7/1987 | Pernick | 66/176 |
| 5,081,854 | 1/1992 | Lonati | 66/176 |

FOREIGN PATENT DOCUMENTS

| | | |
|---|---|---|
| 0387766 | 9/1990 | European Pat. Off. . |
| 2220150 | 9/1974 | France . |

*Primary Examiner*—John J. Calvert
*Attorney, Agent, or Firm*—Bell, Seltzer, Park & Gibson, P.A.

[57] ABSTRACT

The invention discloses a legged panty having strategically-located support panels for minimizing the appearance of undesirable body bulges, particularly along a wearer's stomach, hips and thighs. The panty is circularly knit, and the support panels are integrally knit using a modified knit structure to provide these regions with a greater resistance to stretching, particularly coursewise stretching. In a preferred form of the invention, first and second support panels extend vertically along the outer side of the leg portions, to correspond with the outer thigh regions of a wearer. The panty legs are finished via an integrally knit turned welt located at their terminal ends. The panty also desirably includes a U-shaped or anchor shaped support panel about the gluteal crease region in order to provide support for the buttocks, and additional yarn courses provide areas of added fabric fullness, particularly at the regions corresponding to the buttock cheeks. A stomach bulge control panel is also disclosed, as are a method and blank for making the panty with the body-contouring support panels.

36 Claims, 2 Drawing Sheets

CIRCULARLY KNIT LEGGED PANTY HAVING KNIT-IN SHAPING PANELS, AND A BLANK AND METHOD FOR MAKING SAME

This application is a Continuation-in-Part of copending U.S. patent application Ser. No. 08/382,864, filed Feb. 3, 1995 for "Panty Having Knit-In Buttock Lift and Separation."

BACKGROUND OF THE INVENTION (1) Field of the Invention

The present invention relates to a panty-type undergarment for strategically shaping a wearer's body, a blank for making the panty and a method for making the panty. More specifically, the invention relates to a legged panty having knit-in buttock lift and separation panels, stomach, hip and thigh control support panels, and a blank and method for making the same.

(2) Description of the Prior Art

As an effect of the aging process and overdulgence in food and drink, many people experience a drooping and flattening of their posterior region and expansion of their stomachs, hips and thighs. For many people, particularly women, the outer thigh regions have a tendency to protrude to form what are commonly known as "saddlebags." The appearance of a saggy posterior, stomach bulge and saddlebags is seen by many people to be unattractive; therefore attempts have been made to provide a means for enhancing the appearance of these bulges.

One such means for controlling and minimizing the appearance of body bulges is the girdle. Girdles are conventionally made from a number of pieces which are sewn together to form a compressive legged undergarment. Such girdles are typically designed to compress the entire region of the wearer's body that they cover, and they are notoriously known for being uncomfortable.

U.S. Pat. No. 3,375,829 to Brennan et al describes some attempts which have been made to provide all-way stretch girdles with areas of limited stretch. These attempts include laminating portions of the girdle with a fabric layer or spraying girdle portions with vulcanized latex or a resin. These processes, however, tend to be labor intensive and expensive, and the latex or resin portions can be undesirable feeling next to a wearer's skin.

U.S. Pat. No. 2,928,397 to Pucci and U.S. Pat. No. 3,131,698 to Morano disclose girdle-type undergarments for enhancing the appearance of a wearer's posterior. The girdle of the Pucci patent utilizes a two-part, non-stretchable panel covering the inner half of each buttocks cheek, and a center seam for extending between the two cheeks. The girdle of the Morano patent includes a panel of vertically stretchable material forming the back girdle portion, with the remainder of the girdle being formed of two-way stretch material. Both the Pucci and Morano girdles require the forming and seaming of individual panels to form the completed girdle; therefore production of these garments tends to be labor intensive and costly.

U.S. Pat. No. 2,980,114 to Montoya discloses a skirted girdle, which attempts to avoid pressing together the individual buttocks by providing separate girdle panels which are joined together by way of elastic or open work bands. Because the individual panels must be attached to the bands and specially sewn or configured to provide fullness for accommodating the buttocks, the production of this girdle would tend to be labor intensive as well.

U.S. Pat. No. 3,413,824 to Kuney discloses knitted garments which include form-fitting pockets in order that they can accentuate specific portions of the body. The garments are knitted using a constant knit structure, with the stitch length being varied in selected areas to form spaced concave areas which are to correspond to specific regions of the wearer's body. In the illustrated embodiments, the nether garments include loosely knit regions corresponding to the buttock cheeks and a tightly knit seam piece extending vertically between the loosely knit regions.

U.S. Pat. No. 4,390,999 to Lawson et al. describes the provision of a fabric portion having a medium amount of compressive force between a highly compressive upper waist or leg portion and a low compression body portion, in order to ease the transition from the highly compressive portion to the low compression portion and reduce the resultant body bulge. The areas providing the medium amount of compressive force are shaped and located so that they extend circumferentially about the waist or leg of the wearer in the manner of a band, and they are formed by changing the yarn used to knit various courses.

U.S. Pat. No. 3,526,229 to Blair describes a legged panty having areas designed to provide differing amounts of compressive force. The girdle is formed from a plurality of fabric pieces which are sewn together; therefore construction of these undergarments is necessarily labor intensive.

Thus, a need exists for panty-type undergarments which provide effective strategic support for bulge-prone areas and which can be rapidly and efficiently manufactured using a minimal number of manufacturing steps. In addition, a need exists for a blank for making such panties and a method for making the same.

SUMMARY OF THE INVENTION

It is therefore an object of the present invention to provide a method for making a blank from which a panty can be made having strategically located, integrally knit support panels for enhancing the appearance of a wearer's figure.

It is a further object of the invention to provide a blank which can be readily converted into a panty having support panels for strategically shaping the contours of a wearer's figure.

It is also an object of the invention to provide a method of making a legged panty having strategically located, integrally knit support panels for enhancing the appearance of a wearer's figure.

An additional object of the invention is to provide a method of making a legged panty from a circular knit blank, wherein the conversion of the blank into the panty requires only a minimal number of steps and small amount of labor.

A further object of the invention is the provision of a legged panty having strategically located, integrally knit support panels for minimizing the appearance of undesirable body bulges.

It is another object of the invention to provide a legged panty which is formed of a single piece of material and can be manufactured with only a minimal input of labor.

These and other objects are accomplished through the provision of a circularly-knit panty having integrally knit support panels and leg portions. As used herein, the term "panty" refers to articles of wearing apparel used to clothe at least a portion of a person's body between the waist and thighs, a portion of which extends between a wearer's legs, and which preferably includes leg portions. Though particularly intended for wearing under other clothing, garments made according to the present invention can be worn as outer garments as well. In addition, the garments may be worn by males and females, adults and children alike, and may be specially configured to accommodate the specific sex or age of the wearer, such as by providing a supplemental crotch portion on a women's panty version.

A panty blank according to the present invention is knit on a circular knitting machine and includes a cylindrical, tubular fabric portion in the form of a turned welt about its upper edge for forming a panty waistband, and a tubular body portion knit to said turned welt. For descriptive purposes the tubular body portion includes front and rear portions which are integrally knit together along first and second side portions. It should be understood, however, that these sections are all part of the circularly knit tubular body portion, and are referred to herein as separate portions only in order that the location of various features can be illustrated.

The tubular body portion of the blank is knit so as to have sufficient walewise length so that a panty made therefrom is sufficiently long to cover a portion of a wearer between the waist and the juncture of the body and legs, and to form leg portions, the length of which may vary as discussed below. The blank is completed by knitting a non-raveling edge, preferably in the form of a turned welt, to the leg portion of the body portion.

Support panels are integrally knit into the body portion, with the knit structure of the support panels being modified from that of the rest of the panty so that the support panels have a greater resistance to stretch, particularly coursewise stretch, than the remainder of the panty portions. A particularly preferred blank construction includes an upper turned welt portion which is integrally knit to a body portion, which is in turn knit to a second turned welt, and in which support panels are integrally knit in the body portion in the form of first and second strips which extend in a walewise direction along opposite sides of the tubular blank. In this way, when the blank is converted into a panty, the support panels will overlie the outer hips and thighs or "saddlebag" regions of the wearer's body, thereby controlling undesirable bulging in these conventionally bulge-prone areas.

In addition, support panels are preferably included on the front and rear blank portions, with the support panel on the blank front portion being shaped and positioned to correspond to the stomach region of a wearer of a panty made from the blank and the support panel on the rear portion being substantially U-shaped and positioned to correspond to the gluteal crease region of a wearer when the blank is converted to a panty, thereby providing lifting support to the wearer's buttocks. In another preferred embodiment, a substantially anchor-shaped support panel is knit into the rear panty portion to provide buttock lift and separation in the manner disclosed the above-referenced application Ser. No. 08/382,864.

The method for converting the blank into a panty is performed as follows: the blank is knit in the manner described above, then first and second portions of the blank are removed to form a crotch area and define first and second leg portions. The front portion is then seamed or otherwise joined to the rear portion along the inner portions of the leg and the crotch to thereby form a completed panty. In this way, and as discussed above, the panty can be formed from a minimal number of pieces, have a minimal number of seams, and thus require only a minimal input of labor.

The panty includes a front portion adapted to cover at least a portion of the front of a person between the waist and juncture of the thighs, and a rear portion for covering at least a portion of the buttocks of the wearer. The front and rear portions are integrally knit on a circular knitting machine so that they are joined together along first and second sides. The body portion also includes leg portions which preferably are sufficiently long to cover a major portion of a wearer's thighs.

The support panels are knit so that they have a greater resistance to stretch, particularly coursewise stretch, than the remainder of the panty. The shaping and location of the support panels can be selected by the manufacturer to provide panties having a variety of support panel patterns, thereby enabling a wearer to select a panty particularly suited to minimize his or her particular figure flaws, and one which provides support in the particular regions desired by the wearer. Preferably, the support panels are configured to correspond to and control the protruding appearance of bulge-prone areas, such as the stomach, buttocks, hips and thighs. In addition, support panels can be provided beneath the cheeks of the wearer's buttocks, in the region of the gluteal crease, to provide buttock lift, thereby minimizing the appearance of buttock droop. A preferred arrangement of the support panels includes strip-like panels extending vertically along the outer hip and thigh areas, a substantially U-shaped buttock support panel corresponding to the gluteal crease of the wearer's body, and a stomach panel for covering the stomach region of the wearer.

In a particularly preferred embodiment of the invention, the panty includes a substantially anchor-shaped support panel integrally knit with the rear portion such that the support panel extends vertically through the center of the rear portion and curves around toward and along a portion of the first and second leg portions in order that it conforms to the regions of a wearer's body corresponding to the areas between and beneath the wearer's buttock cheeks (i.e. the gluteal crease).

The more stretch resistant support panels are formed by modifying the knit structure in the support panel regions. This can be accomplished by using conventional knitting structures, such as floating in an elastic yarn or tucking a yarn used to form the series of courses in selected alternating courses. Thus, a panty having leg portions and integrally knit support panels can be readily formed with only a minimal number of steps and without requiring a large amount of labor input.

In addition, an additional yarn or yarns can be fed in to form additional courses, thereby forming areas having added fabric fullness. For example, these additional courses can be provided in a panty region which will correspond to the buttock cheeks of the wearer when the panty is worn.

Other objects, features and advantages of the present invention will become apparent from the following detailed description when taken in conjunction with the accompanying drawings, in which like numbers represent like elements throughout the figures and primed numbers represent like elements in alternative embodiments of the invention.

DESCRIPTION OF THE PREFERRED EMBODIMENTS

Figure 1:
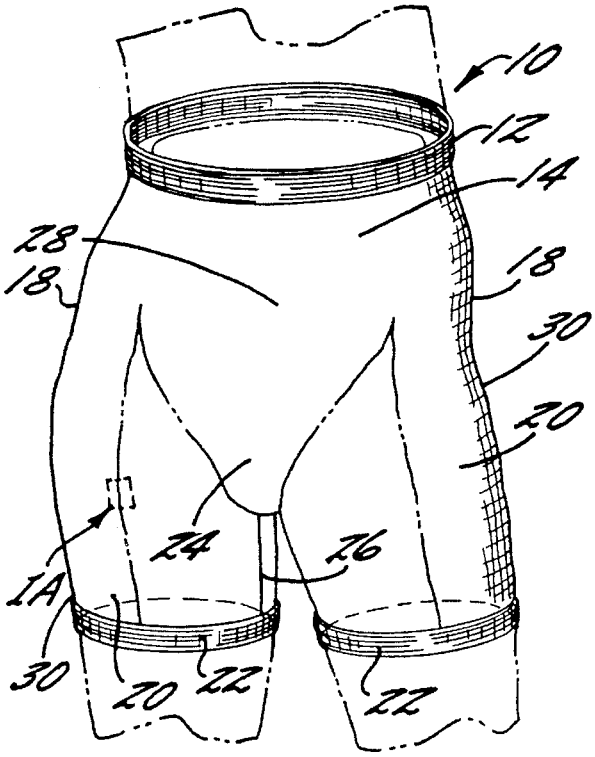
FIG. 1 is a front environmental view of a panty according to the invention.
Figure 2:
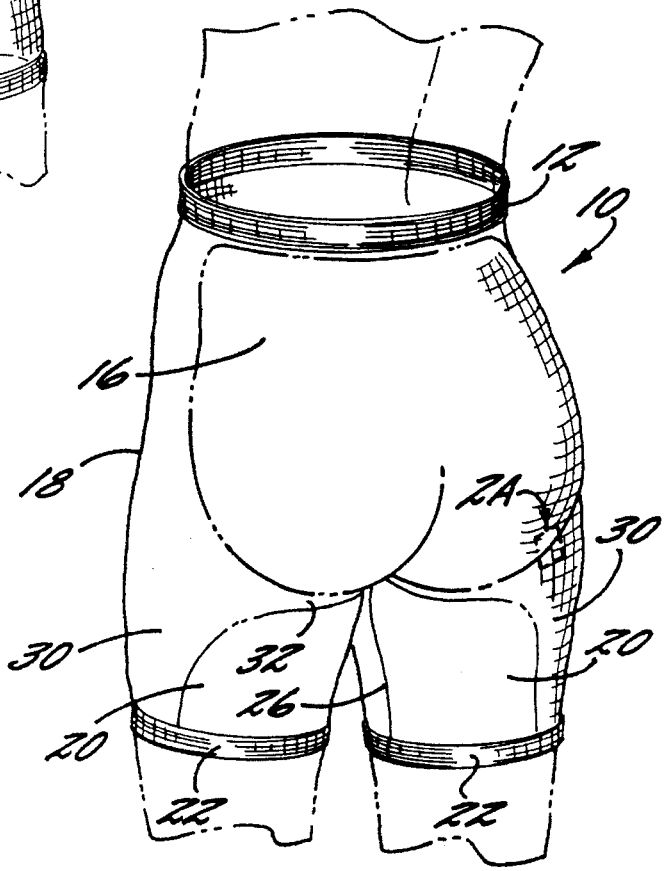
FIG. 2 is a rear environmental view of a panty according to the invention.

Referring now to the drawings, FIGS. 1 and 2 respectively show front and rear views of a panty according to the invention as it appears when it is worn. As shown in FIG. 1, the panty 10 includes a waistband 12 which is preferably in the form of a turned welt. Integrally knit with the turned welt 12 are a is a tubular body portion having front and rear portions 14, 16, respectively, which are integrally knit together along side portions be. The panty also includes leg portions 20 which extend along at least the upper thighs of the wearer. Though depicted as extending about halfway down the wearer's thighs, the leg portions 20 may extend any distance from a minor portion of the thighs to the full length of the leg, in the manner of tights or stockings.

The front portion 14 and rear portion 16 are joined together along seam 26 to form a crotch portion 24 between the leg portions 20. The seam 26 can be formed by sewing or other conventional methods of attachment. The leg portions 20 terminate in a non-raveling edge 22 which is preferably in the form of a turned welt, as this provides a hemmed look to the leg portions 20 without requiring the added labor input of manual or machine hemming.

The panty 10 also includes integrally knit support panels 28, 30, and 32 which have a greater resistance to stretch, particularly coursewise stretch, than the remainder of the panty fabric. Though the support panels can take on a variety of patterns and configurations, a preferred embodiment of the invention provides support panels which control stomach bulge, buttocks droop and hip and thigh bulging, as these conventionally tend to be bulge-prone areas. This is accomplished through the provision of a stomach panel 28 which controls stomach bulge and vertically extending strip-like side panels 30 which extend along opposite sides 18 of the panty to thereby conform to the outer hip and thigh or saddlebag region of a wearer's body. In a preferred form of the invention, the stomach panel 28 is shaped to cover that part of the stomach area of a wearer which extends from the waist to the crotch, and is therefore somewhat hexagonally shaped (i.e. has approximately six sides, though the sides need not be of the same length). Also in a preferred form of the invention, each of the vertically extending strip-like side panels 30 is approximately 1–5 inches in width in a panty having a circumference of approximately 16–24 inches. However, as would be readily appreciated by one having ordinary skill in the art, a variety of panty sizes and support panel sizes could be utilized and are within the scope of the invention.

Figure 2A:
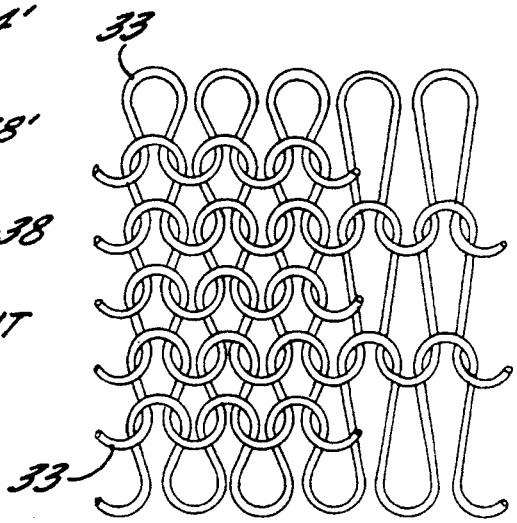
FIG. 2A is a greatly enlarged view of a section of FIG. 1, showing an example of additional yarns being fed in to form additional courses at specified locations.

In addition, as shown in FIG. 2, the panty 10 also desirably includes a substantially U-shaped support panel 32 which provides for lift and support of the buttocks, thereby providing the wearer with a more youthful and fit appearance. Further, in order to provide more fullness to the buttock cheek covering portion of the panty 10, an additional yarn or yarns can be fed in to form additional courses in those or other regions where added fullness would be appreciated. FIG 2A illustrates an example of additional yarns 33 being fed in to form additional courses to provide additional fullness in a portion of the garment. In a preferred form of the invention, such additional courses can be provided immediately above the substantially U-shaped support panel 32, to provide a greater amount of fabric for covering the buttock cheeks.

Figure 1A:
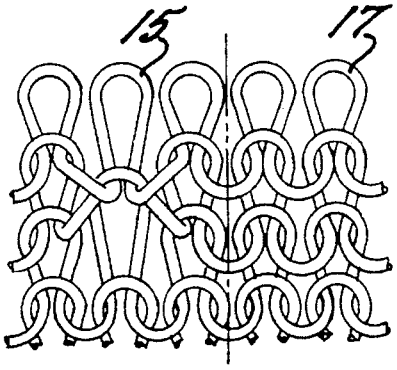
FIG. 1A is a greatly enlarged view of a section of FIG. 1, showing an example of the knitting transition between the support panel and the rest of the body portion construction.
Figure 1B:
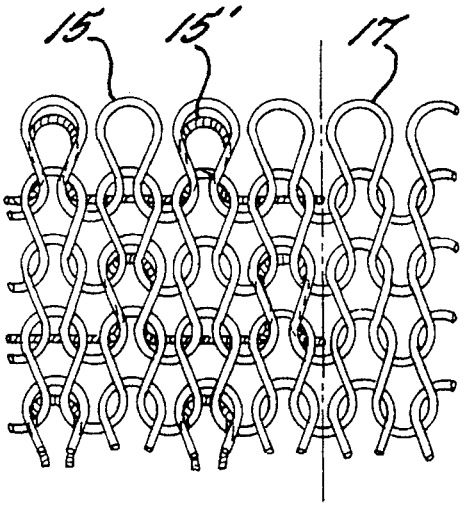
FIG 1B is a greatly enlarged view of a section of FIG. 1, showing an alternative example of the knitting transition between the support panel and the rest of the body portion.

The support panels 28, 30, and 32, are integrally formed through the modification of the knit structure forming the remainder of the body portion. For example, the tubular body portion can be flat or jersey knit as shown at 17 of FIGS. 1A, and 1B with the support panels being formed by floating in an extra elastic yarn in the more stretch-resistant regions, as shown at 15' in FIG. 1B, or by forming the stretch-resistant regions using a pucker stitch wherein yarns are tucked during the formation of selected portions of selected alternating courses, as shown at 15 in FIG. 1A. However, other conventional methods for forming the more stretch-resistant support panels can be used, as would be understood by one having ordinary skill in the art. Further, the support panels can be extended so that they meet in certain regions, in the manner shown in the Figures, to form integral panels which cover a number of desired sites at once.

Figure 3:
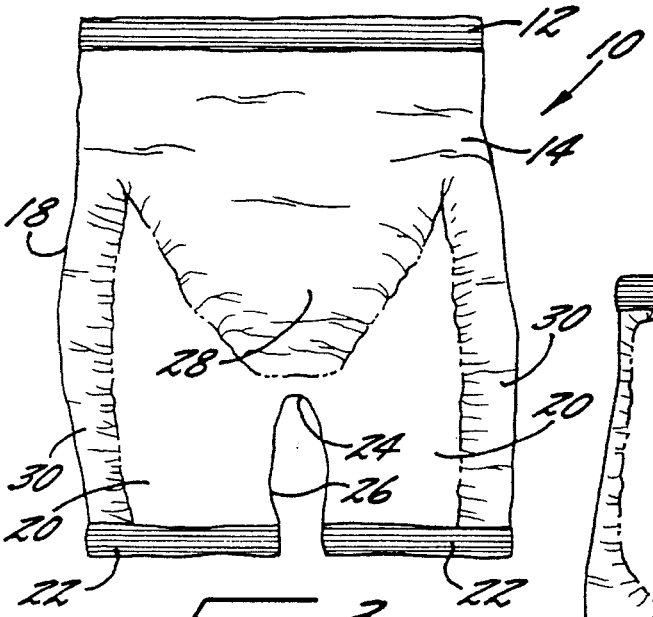
FIG. 3 is a front plan view of a panty according to the invention.

FIG. 3 is a front plan view of a panty 10 according to the invention. As discussed above with respect to FIG. 1, the panty includes a waistband 12, preferably in the form of a turned welt, a front portion 14, a stomach bulge control panel 28, and vertically extending hip and thigh bulge control panels 30. The entire panty is knit in one piece and can be formed through the provision of a single seam 26. Though the stomach bulge control panel 28 specifically is depicted as covering an area of the panty which would correspond to a significant portion of the stomach region of a wearer, it should be noted that the panel could be shaped to cover only a minor portion thereof, such as a part closer to the waist only.

Figure 4:
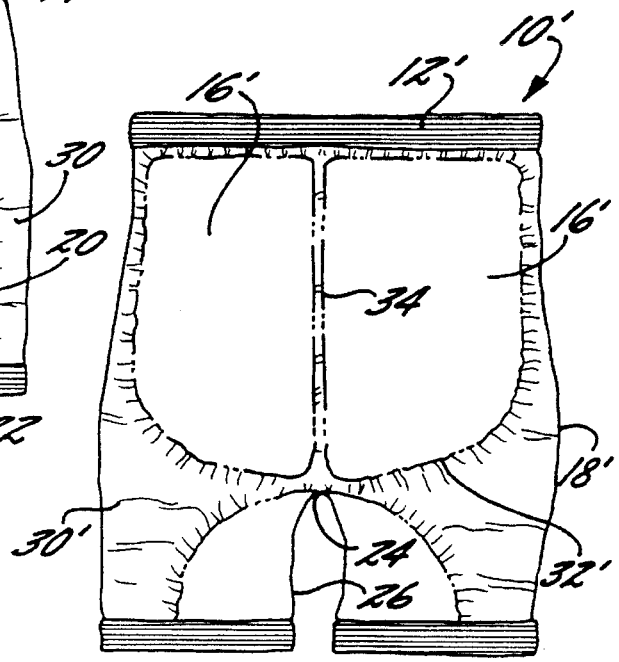
FIG. 4 is a rear plan view of a panty according to the invention showing an alternative support panel configuration on the rear panty portion.

FIG. 4 shows a view of a rear portion 16' of a panty 10 like that shown in FIG. 3, which has an alternative support panel arrangement on the rear portion thereof. The support panel configuration in FIG. 4, like that shown in FIG. 2, includes vertically extending hip and thigh bulge control panels 18' and a substantially U-shaped buttock lift panel 32'.

Figure 5:
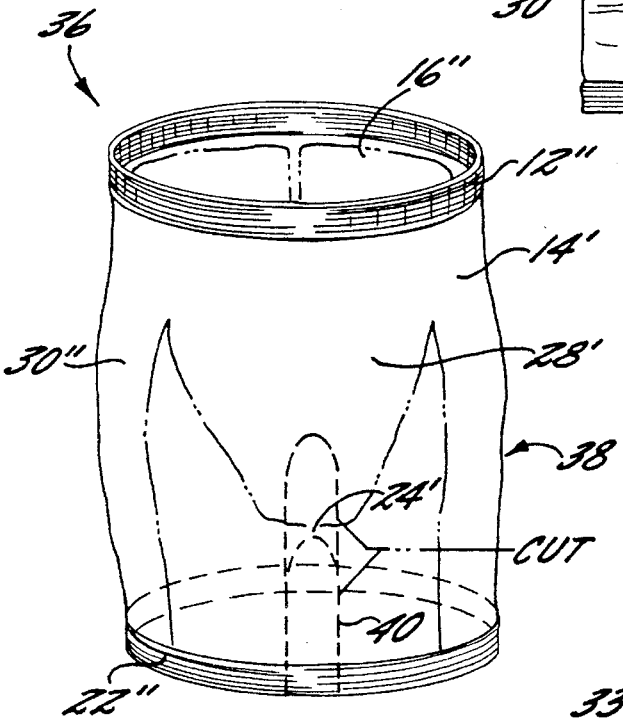
FIG. 5 is a perspective view of a blank according to the present invention.

In addition, the embodiment shown in FIG. 4 includes a vertically extending support panel 34 extending through the center portion of the rear portion 16'. This vertically extending support panel 34 cooperates with the U-shaped panel 32' to form a substantially anchor-shaped panel on the rear portion of the panty 10' The U-shaped panel 32' the vertically extending panel 34 and the turned welt 12' cooperate to provide buttocks lift and separation, as the U-shaped panel 32' cooperates with the gluteal crease of the wearer's body and the panel 34 cooperates with the space between the buttocks cheeks to thereby lift and define the shape of the wearer's derriere. As will be recognized by those of skill in the art, the anchor-shaped support panel can assume configurations other than that shown in FIG. 4, such as one in which the vertically extending panel 34 is formed by plural spaced-apart regions having a greater resistance to stretch than the rest of the rear portion 16' which cooperate to form the overall vertically extending panel A blank 36 according to the present invention is shown in FIG. 5. The blank 36 includes at its top-most portion a cylindrical tubular fabric portion 12" in the form of a turned welt. A tubular body portion 38 is knitted to the turned welt portion 12" and includes areas such as those shown at 28' and 30" in which the knitting structure is modified in order to form selected discrete regions which have a greater resistance to stretch that the remainder of the tubular structure, particularly in the coursewise direction. This can be accomplished by floating in an extra elastic yarn in the more stretch-resistant regions or by forming the stretch-resistant regions using a pucker stitch wherein yarns are tucked during the formation of selected portions of selected alternating courses. However, other conventional methods for forming the more stretch-resistant support panels can be used, as would be understood by one having ordinary skill in the art.

The blank is completed by knitting to the body portion 38 a non-raveling edge 22". In preferred form of the invention, this non-raveling edge 22' is provided in the form of a turned welt as the turned welt provides a neat finish for the leg portions 20 of the panty 10 without requiring supplemental steps such as hemming of the leg portions.

To form a panty 10, 10' from the blank 36, the blank is cut along cut lines 40 to define a crotch 24 and leg encircling portions 20. The front and rear portions 14', 16" of the tubular body portion 38 are joined together along the cut lines 40 via a seam 26 or other attachment means to thereby form a completed panty 10, 10'.

As can readily be understood, a legged panty thus can be made from the blank 36 using only a single seam. In addition, the crotch region 24' of the blank 36 could be modified in a conventional manner to provide a terry crotch portion or the like, as could readily be understood by one of ordinary skill in the art. Further, a supplemental crotch piece or lining could be provided in a conventional manner.

In addition, the shape, number of, and configuration of the support panels can be readily configured by the manufacturer during blank manufacture to produce panties which will accommodate a variety of figure shapes and enhance particular figure features. For example, the panty could include the thigh and saddlebag vertical strip-shaped side panels 30, 30' without employing the stomach panel 28. Similarly, the panty could be made to have the stomach panel 28 and the U-shaped buttocks lift panel 32, 32' without requiring the use of the vertical strip-shaped side panels 30. In this way, a manufacturer can produce various models of undergarments whereby the wearer can select the panty which most specifically corresponds to his or her figure needs.

In the drawings and specification there has been set forth the best mode presently contemplated for the practice of the invention, and although specific terms are employed, they are used in a generic and descriptive sense only and not for purposes of limitation, the scope of the invention being defined in the claims.

That which is claimed is:

1. A method of making a blank for a legged panty having a minimal number of pieces and seams comprising:

knitting a series of courses to form a cylindrical, tubular fabric portion in the form of a turned welt;

knitting to the turned welt a series of courses defining a tubular body portion including leg forming portions and while knitting the tubular body portion, periodically modifying the knit structure to form non-circumferential discrete regions having a greater coursewise resistance to stretch than the remainder of the tubular body portion, said discrete regions defining body support panels; and then completing the blank by knitting to the body portion a series of courses defining a non-raveling edge.

2. The method according to claim 1, wherein said step of knitting a non-raveling edge includes knitting a cylindrical tubular fabric portion in the form of a turned welt.

3. The method according to claim 1, wherein said step of periodically modifying the knit structure to form a plurality of discrete regions defining body support panels comprises floating an elastic yarn into the courses.

4. The method according to claim 1, wherein said step of periodically modifying the knit structure to form a plurality of discrete regions defining body support panels comprises tucking a yarn used to form said series of courses in selected alternating courses.

5. The method according to claim 1, wherein said step of periodically modifying the knit structure to form body support panels comprises periodically modifying the series of courses to form first and second walewise extending strip-shaped support panels along opposite sides of said tubular body portion.

6. The method according to claim 1, wherein said tubular body portion includes front and rear portions and said step of periodically modifying the knit structure to form body support panels comprises periodically modifying the series of courses to form a substantially U-shaped support panel along the rear portion of the tubular body portion.

7. The method according to claim 6, wherein said step of knitting a series of courses defining a tubular body portion includes feeding an additional yarn into the series of courses in predetermined areas of said rear portion to form additional courses in a region immediately above the substantially U-shaped support panel, thereby forming blank regions having added fullness.

8. The method according to claim 1, wherein said tubular body portion includes front and rear portions and said step of periodically modifying the knit structure to form body support panels comprises periodically modifying the series of courses to form a substantially anchor-shaped support panel along the rear portion of the tubular body portion.

9. The method according to claim 1, wherein said tubular body portion includes front and rear portions and said step of periodically modifying the knit structure to form body support panels comprises periodically modifying the series of courses to form a somewhat hexagonally-shaped support panel along an upper portion of the front portion of the tubular body portion, to thereby form a support panel adapted to cover a stomach region of a wearer when the blank is formed into a completed panty.

10. The method according to claim 1, wherein said tubular body portion includes front and rear portions and said step of periodically modifying the knit structure to form body support panels comprises periodically modifying the series of courses to form first and second walewise extending strip-shaped support panels along opposite sides of the tubular body portion, a substantially hexagonally-shaped support panel on an upper portion of the front portion, and a substantially U-shaped support panel on the rear portion of the tubular body portion.

11. A circularly knit blank for the manufacture of a legged panty having strategically located body shaping panels comprising:

a series of courses defining a cylindrical tubular fabric waistband portion in the form a turned welt;

a series of courses knit to the waistband portion and defining a tubular body portion, said tubular body portion including leg forming portions and a plurality of predetermined non-circumferential discrete regions defined by a modified stitch structure having a greater coursewise resistance to stretch than the remainder of the tubular body portion, and a second series of courses defining a non-raveling edge knit to said body portion at an end thereof remote from said waistband portion.

12. The circularly knit blank according to claim 11, wherein said non-raveling edge comprises a cylindrical tubular fabric portion in the form of a turned welt.

13. The circularly knit blank according to claim 11, wherein said predetermined discrete regions having a greater coursewise resistance to stretch include floated-in elastic yarns.

14. The circularly knit blank according to claim 11, wherein said predetermined discrete regions having a greater coursewise resistance to stretch include a plurality of tucked yarns, thereby providing the regions with stretch resistance.

15. The circularly knit blank according to claim 11, wherein said predetermined discrete regions having a greater coursewise resistance to stretch comprise first and second walewise extending strips located along opposite sides of said tubular body portion.

16. The circularly knit blank according to claim 11, wherein said tubular body portion includes a front portion and a rear portion, and said predetermined discrete regions having a greater coursewise resistance to stretch include a substantially U-shaped region located on said rear portion.

17. The circularly knit blank according to claim 16, further comprising discrete regions having knit-in fullness formed by an additional fed-in yarn which forms additional courses in said discrete regions, said discrete regions being located immediately above said substantially U-shaped region.

18. The circularly knit blank according to claim 11, wherein said tubular body portion includes a front portion and a rear portion, and said predetermined discrete regions having a greater coursewise resistance to stretch include a substantially hexagonally-shaped region located on said front portion.

19. The circularly knit blank according to claim 11, wherein said tubular body portion includes front and rear portions and said predetermined discrete regions having a greater coursewise resistance to stretch include first and second walewise extending strips located along opposite sides of said tubular body portion, a substantially U-shaped region located on said rear portion, and a substantially hexagonally-shaped region located on said front portion.

20. A method of making a legged panty having a minimal number of pieces and seams comprising:

knitting a series of courses to form a cylindrical, tubular fabric portion in the form of a turned welt;

knitting to the turned welt a series of courses defining a tubular body portion including leg forming portions and while knitting the tubular body portion, periodically modifying the series of courses to form a plurality of predetermined non-circumferential regions having a greater coursewise resistance to stretch than the remainder of the tubular structure;

knitting to the tubular body portion a series of courses defining a non-raveling edge; and cutting and removing from the tubular body portion and one of the turned welt portions first and second spaced fabric portions to define front and rear panty portions, each portion including first and second leg portions; and attaching the front panty portion to the rear panty portion along and between the first and second leg portions, to thereby form a completed legged panty.

21. The method according to claim 20, further comprising the step of hemming the leg portions adjacent the non-raveling edge.

22. The method according to claim 20, wherein said step of knitting to the tubular body portion a series of courses defining a non-raveling edge comprises knitting a cylindrical, tubular fabric portion in the form of a turned welt.

23. The method according to claim 20, wherein said step of attaching said front panty portion to said rear panty portion comprises sewing the portions together.

24. A circularly knit panty having integrally knit support panels comprising:

a waistband defined by a cylindrical tubular knit fabric portion in the form of a turned welt;

front and rear portions integrally knit to said waistband and with each other to form a body portion, support panels formed in said body portion in non-circumferential discrete region, said body portion including first and second leg portions for covering at least a portion of the thighs of a wearer's body when the panty is worn, each of said leg portions terminating in a cylindrical fabric portion in the form of a turned welt, and a single seam attaching said front and rear portions along a crotch portion and inner portions of said first and second leg portions.

25. A circularly knit panty having a minimal number of pieces comprising:

a waistband defined by a cylindrical tubular knit fabric portion in the form of a turned welt;

a plurality of courses defining front and rear portions integrally knit to said waistband to form a tubular body portion, said body portion including first and second leg portions for covering at least a portion of the thighs of a wearer's body when the panty is worn, and said body portion including an integrally knit non-circumferential support panel defined by a region in which the courses forming the body portion have a modified knit structure having a greater resistance to coursewise stretching than the courses forming the remainder of the body portion, said support panel being positioned to provide shaping support for a predetermined portion of a wearer's body.

26. The circularly knit panty according to claim 25, wherein said front and rear portions are joined along a single seam located along and between said first and second leg portions.

27. The circularly knit panty according to claim 25, further comprising a cylindrical fabric portion in the form of a turned welt located at a distal end of each of said first and second leg portions.

28. The circularly knit panty according to claim 25, wherein said support panel is substantially U-shaped and is located on said rear portion of said body portion.

29. The circularly knit panty according to claim 25, wherein a first substantially strip-shaped support panel extends vertically along an outer side of said first leg portion and a second substantially strip-shaped support panel extends vertically along an outer side of said second leg portion.

30. The circularly knit panty according to claim 25, wherein said support panel is substantially hexagonally-shaped and is located on said front portion of said body portion.

31. The circularly knit panty according to claim 25, including a substantially U-shaped support panel located on said rear portion of said body portion, a first substantially strip-shaped support panel extending vertically along an outer side of said first leg portion, a second substantially strip-shaped support panel extending vertically along an outer side of said second leg portion, and a substantially hexagonally-shaped support panel located on said front portion of said body portion.

32. The circularly knit panty according to claim 25, wherein said support panel is substantially anchor-shaped and is located on said rear portion of said body portion.

33. The circularly knit panty according to claim 25, wherein said support panel includes floated-in elastic yarns.

34. The circularly knit panty according to claim 25, wherein said support panel includes a plurality of tucked yarns.

35. The circularly knit panty according to claim 25, further comprising at least one discrete region having added fullness formed by an additional fed-in yarn forming additional courses.

36. The circularly knit panty according to claim 35, wherein said at least one discrete region having added fullness is located on said rear portion.

* * * * *

UNITED STATES PATENT AND TRADEMARK OFFICE

CERTIFICATE OF CORRECTION

PATENT NO. : 5,590,548

DATED : January 7, 1997

INVENTOR(S) : Harold G. Osborne

It is certified that error appears in the above-indentified patent and that said Letters Patent is hereby corrected as shown below:

Column 1, line 38, after "et al", insert --.--.

Column 3, line 53, after "disclosed", insert --in--.

Column 4, line 65, after "FIG", insert --.--.

Column 5, line 23, after "12", delete --are a--.

Column 5, line 25, "be" should be --18--.

Column 6, line 16, after "1A", delete --,--.

Column 6, line 16, after "1B", insert --,--.

Column 6, line 53, after "10'", insert --.--.

Column 6, line 65, after "panel", insert --34--.

Column 7, line 6, "that" should be --than--.

Column 7, line 17, after "In", insert --a--.

UNITED STATES PATENT AND TRADEMARK OFFICE

CERTIFICATE OF CORRECTION

PATENT NO. : 5,590,548
DATED : January 7, 1997
INVENTOR(S) : Harold G. Osborne

It is certified that error appears in the above-indentified patent and that said Letters Patent is hereby corrected as shown below:

Column 7, line 18, "22′" should be --22"--.

Column 9, line 55, after "non-circumferential" insert --discrete--.

Column 10, line 19, "region," should be --regions,--.

Signed and Sealed this

Thirteenth Day of May, 1997

Bruce Lehman

*Attest:*

BRUCE LEHMAN

*Attesting Officer*

*Commissioner of Patents and Trademarks*